United States Patent [19]

O'Connell

[11] Patent Number: 5,006,047

[45] Date of Patent: Apr. 9, 1991

[54] COMPRESSOR WITH A SEGMENTED PISTON ROD ASSEMBLY

[75] Inventor: Mark O'Connell, Cedar Grove, Wis.

[73] Assignee: Thomas Industries, Inc., Sheboygan, Wis.

[21] Appl. No.: 317,886

[22] Filed: Feb. 27, 1989

[51] Int. Cl.[5] ..... F04B 19/00

[52] U.S. Cl. ..... 417/238; 417/553; 97/258; 97/13.41

[58] Field of Search ..... 417/238, 553; 92/59, 92/128, 255, 257, 258, 13.4, 13.41

[56] References Cited

U.S. PATENT DOCUMENTS

| | | | |
|---|---|---|---|
| 1,776,147 | 9/1930 | Clagett | 417/555.1 |
| 1,977,075 | 10/1934 | Magnuson | 92/258 |
| 2,092,087 | 9/1937 | Saharoff | 92/258 |
| 2,627,250 | 2/1953 | Marsh | 417/437 |
| 2,729,388 | 1/1956 | Ringham | 92/258 |
| 2,836,474 | 5/1958 | Mosher | 417/437 |
| 3,131,609 | 5/1964 | Dobrikin | 92/128 |
| 3,744,382 | 7/1973 | Williams | 92/258 |
| 4,519,753 | 5/1985 | Kitsnik | 417/555.1 |
| 4,628,795 | 12/1986 | Pickard et al. | 92/13.41 |

*Primary Examiner*—Leonard E. Smith
*Assistant Examiner*—Eugene L. Szczecina, Jr.
*Attorney, Agent, or Firm*—Baker & McKenzie

[57] ABSTRACT

The invention relates to a compressor having a piston and rod assembly which is segmented to allow adjustment of the compressor's output. In particular, fasteners accessible from the top surface of the piston can be removed so that shims can be added or removed from piston rod. The addition or removal of shims lengthens or shortens the piston rod so that the compression ration can be fine tuned. These adjustments, as well as replacement of the piston seal, can be accomplished without extensive disassembly of the compressor.

2 Claims, 2 Drawing Sheets

COMPRESSOR WITH A SEGMENTED PISTON ROD ASSEMBLY

BACKGROUND AND SUMMARY OF THE INVENTION

The present invention relates to compressors and, in particular, to compressors which have reciprocating pistons carried by an eccentrically rotating member. Such compressors are supplied as components to original equipment manufacturers for use in a wide variety of applications, ranging from spraying equipments to pneumatic tool operation.

In some applications, the precise output of the compressor may be critical. In such situations, it is desirable to be able to adjust or fine tune the compression ratio of the compressor. When used herein, the compression ratio is the ratio of the volume above the piston at the bottom of a stroke to the volume above the piston at the top of a stroke. Therefore, even though the size of a stroke will remain constant with a given eccentric, the output, or compression ratio, can be modified by changing the length of the piston rod. As clearance above the piston at the top of the stroke is reduced by making the rod longer, the compression ratio increases.

In some compressors, there is a need to maximize the compression ratio. In other instances, the optimal compression ratio may be one other than the maximum. In other instances, rod material or assembly considerations, variations in dimensional tolerance may make it impossible to precisely achieve a desired rod length. It is also important to provide adjustability of the piston rod length without extensive or complex operations requiring skilled labor.

Another important factor in compressor performance is the durability of a piston's seal. Depending upon the frictional characteristics or other properties of a seal, continuous or intermittent usage may cause early failure of the seal, even though the other working parts of the compressor may be far from failure. In such cases, replacement of the seal may be desirable. In many compressors, replacement of piston rings or seals is a major undertaking which requires significant time and skilled labor.

It is therefore an object of the invention to provide a compressor in which the piston rod length can be adjusted.

It is a further object of the invention to provide a compressor in which the piston rod length can be changed without extensive disassembly of the compressor which may require skilled labor.

Yet another object of the invention is to provide a compressor in which adjustment of the piston rod length can be achieved quickly and precisely.

Still another object of the invention is to provide a compressor in which the piston seal or ring can be replaced without removing the piston and rod assembly from the compressor.

Yet another object of the invention is to provide a compressor in which both replacement of the piston seal and adjustment of the piston rod length can be achieved with a minimum of complexity and labor.

These and other objects of the invention are achieved with a compressor which includes a housing and a motor driven eccentric onto which is mounted a lower rod piston section. The lower piston section is attached to a main piston section which carries a seal clamp. Fasteners are used to hold a seal between the seal clamp and the main piston section. Other fasteners are used to allow shims to be placed between the lower end of the main piston section and an upper surface of the lower piston rod section to affect a change in the output of the compressor. Both replacement of the seal and adjustment of the piston rod length can be achieved by simply removing the compressor heads and without requiring access to the connection between the lower piston rod and the shaft.

BRIEF DESCRIPTION OF THE DRAWINGS

The objects and advantages of the invention will be better understood upon reading the following in conjunction with the accompanying drawings wherein.

DETAILED DESCRIPTION OF THE INVENTION

Figure 1:
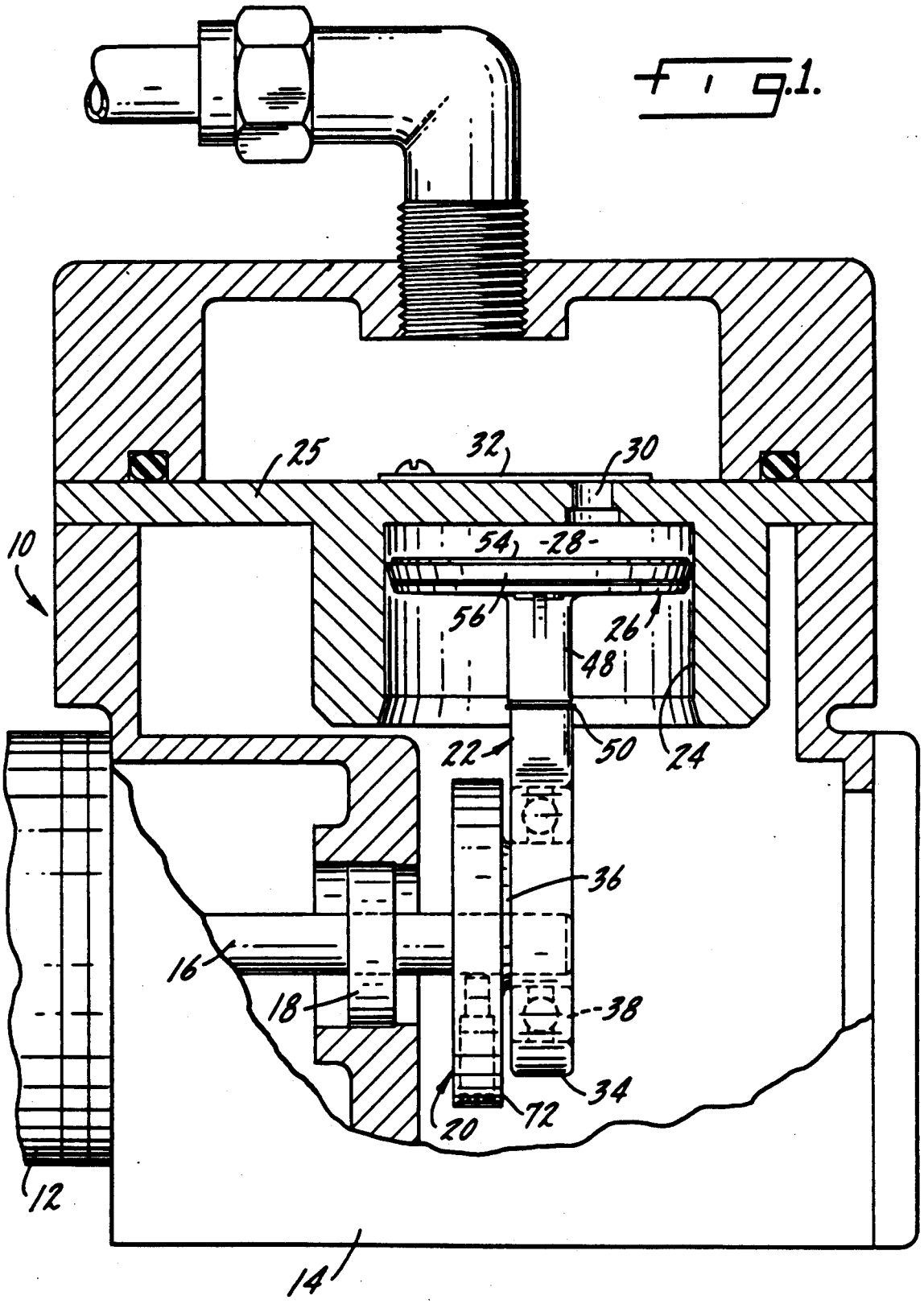
FIG. 1 is a partial sectional view of a compressor embodying the present invention.

FIG. 1 shows a compressor 10 which has a motor 12 and housing 14. A rotating shaft 16 extends from the motor 12 and is supported along its length by a journal bearing 18 as it extends through the housing 14. Attached to the projecting end of the shaft 16 is an eccentric connector 20 fixed against rotation to the shaft by a set screw. A piston rod 22 is attached to the eccentric portion 36 of the eccentric connector 20. The piston rod 22 and piston 26 reciprocate in a cylinder 24. Air compressed in the compression chamber 28 is allowed to exit the chamber through port 30 past the check valve 32.

Figure 2:
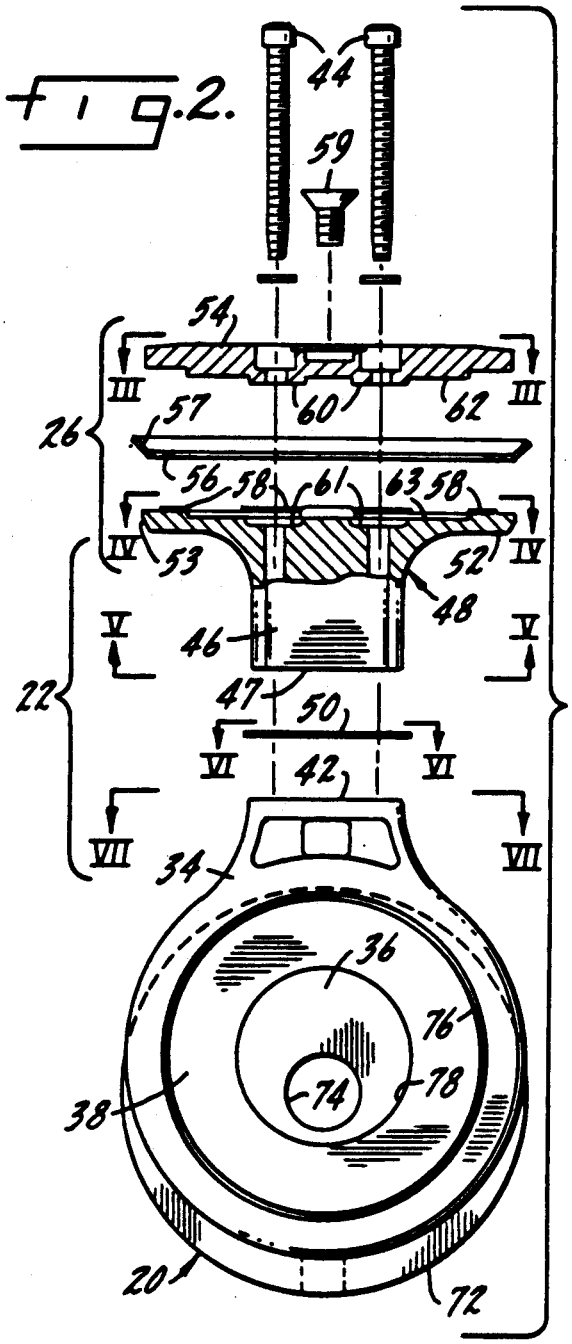
FIG. 2 is an exploded view of the piston rod assembly of the compressor shown in FIG. 1.

FIG. 2 shows the details of the assembly which include the piston 26 and the piston rod 22. A lower rod section 34 is fitted onto the eccentric portion 36 of the eccentric connector 20 with a radial bearing 38 therebetween. The lower rod section 34 is preferably shrunk fitted on the bearing 38 to eliminate the need for fasteners. The upper part of the lower rod section 34 forms part of the piston rod 22 and holes 40 are formed in the upper surface 42. The holes 40 are internally threaded in order to engage the fasteners 44. The lower end 46 of the main piston section 48 forms another segment of the piston rod 20. A shim 50, or a plurality thereof, may be placed between the lower horizontal surface 47 and the upper surface 42 in order to change the length of the piston rod 20.

The main piston section 48 has a flaring or widened upper section 52 which, together with the seal clamp 54 and seal 56, comprise the piston 26. The seal clamp 54 holds the seal 56 against a series of ribs 58 formed on the upper surface of the widened section 52. The widened section 52 has a beveled outer edge 53 to allow rotation of the piston without contacting the cylinder inside of the wall of the cylinder 24 as the lower end of the piston rod rotates eccentrically about the shaft. Fasteners 59 are used to tighten the seal clamp 54 and the seal 56 against the ribs 58.

It should be noted that separation of the rod components 48 and 34 to add shims can be accomplished without loosening the fasteners 59. This allows adjustment of the piston rod length without disturbing the position of the seal 56 relative to the seal clamp 54 and the widened piston section 52. The bosses 60 and 62 help to center the seal clamp 54 during reassembly thereof. The locations of corresponding recesses 61 and 63 in the upper surface of the main piston section 48 are such that the bosses nest in the recesses when the seal clamp 54 is properly aligned with the main piston section 48.

Figure 3:
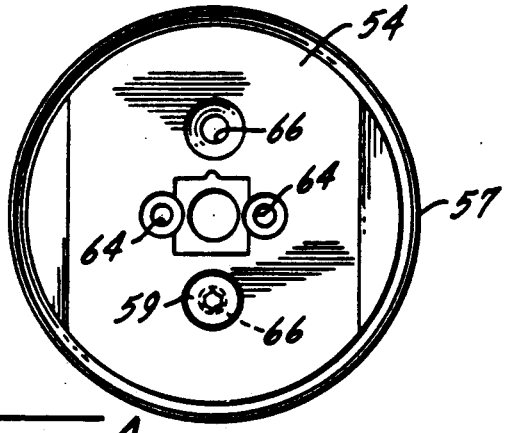
FIG. 3 is a top plan view taken along line III—III of FIG. 2.

FIG. 3 is a top view of the seal clamp 54 showing openings 64 for fasteners 44 and openings 66 for fasteners 59. The outer upwardly extending edge 57 of the seal 56 circumscribes the periphery of the seal clamp 54 and widened section 52, because the seal must engage the wall of cylinder 24.

Figure 4:
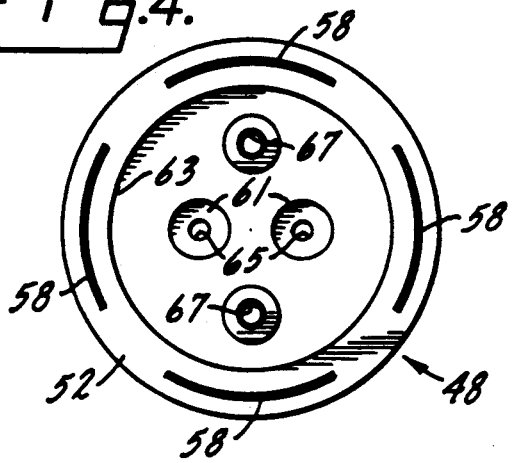
FIG. 4 is a top plan view taken along line IV—IV of FIG. 2.

FIG. 4 shows the upper surface of main piston section 48. Circularly disposed ribs 58 are located a distance in from the outer edge of the widened section 52. Holes 65 are in alignment with holes 64 on the seal clamp, while holes 67 are internally threaded and aligned with holes 66 on the seal clamp. It should be noted that holes 64 and 65 are located at a distance from the axis of the piston which is different from the radial distance at which holes 66 and 67 are spaced from the axis of the piston. Such an arrangement, in addition to the arrangement of the bosses 60 and 62 relative to the recesses 61 and 63, precludes the improper assembly of the fasteners 44 and 59, and thus precludes improper assembly of the seal clamp and the main piston section.

Figure 5:
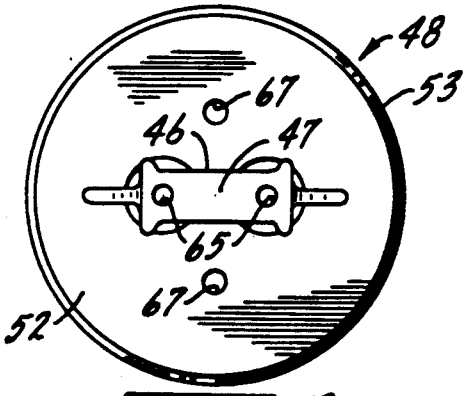
FIG. 5 is a bottom plan view taken along line V—V of FIG. 2.
Figure 6:
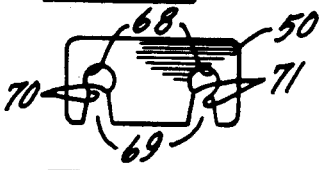
FIG. 6 is a top plan view taken along line VI—VI of FIG. 2.

FIG. 5 is a bottom end view of the main piston section 48. The surface 47 and surface 42 on the lower rod section 34 are adapted to clampingly engage a shim 50 like the one shown in FIG. 6. The shim 50 is approximately similar in shape to the surfaces 47 and 42 and the openings 68 join with slots 69 to facilitate insertion and removal of the shim when fasteners 44 are projecting from holes 65. The corners 70 and 71 are separated by a distance which allows the shim to snap past the fasteners 44 and into position between the surfaces 47 and 42. And the corners 70 and 71 are spaced so that the shim will not slide out of position when the fasteners 44 are present.

Figure 7:
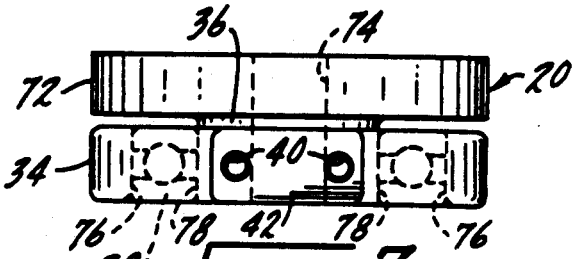
FIG. 7 is a top plan view taken along line VII—VII of FIG. 2.

FIG. 7 is an end view of the lower rod section 34 attached to the eccentric connector 20. The upper surface 42 has threaded holes 40 which engage the threads of fasteners 44. The eccentric connector 20 includes a counterbalancing weight 72 and an integral eccentric post 36 through which is formed the shaft opening 74. The shaft opening also extends through the weight 72. The bearing 38 is held tightly between the outer surface 78 of the post 36 and the inner surface 76 of the large opening in the lower rod section 34.

In operation, the adjustment of the length of piston rod 22 is accomplished by first removing the cylinder head 25 to expose the upper surface of the seal clamp 54. By loosening only screws 44 and not screws 59, an assembler or repair person can remove the piston assembly 26 which includes the clamp 54, the seal 56, and the main piston section 48. With the piston assembly 26 removed, shims can be placed on the surface 42, as needed. By placing or removing shims, the clearance and volume between the piston assembly 26 and the cylinder head 25 can be changed, thereby changing the compression ratio of the compressor.

In addition, by removing fasteners 59 and fasteners 44, the seal clamp 54 can be separated from the main piston section 48 and the seal 56 can be replaced.

If the main piston is cracked, worn or otherwise damaged, it can be easily replaced. The exploded view of FIG. 7 shows how the replacement can be accomplished. Removal of fasteners 44 will allow the piston assembly (including main piston 48, seal 56 and seal clamp 54) to be removed from the cylinder 24. Once the piston assembly is removed, the main piston section 48, the seal 56, or the seal clamp 54, or any combination thereof, can be replaced and placed back into the cylinder. Re-insertion and tightening of the fasteners 44 will complete the reattachment of the piston assembly to the lower rod section 34.

Both the addition or removal of shims and the replacement of the seal can be achieved without disturbing the connection between the lower rod section 34 and the eccentric connector 20 and without disturbing the connection between the eccentric connector and the shaft. Furthermore, these changes and adjustments are possible without the need for removal of the cylinder 24.

The invention has been described above with reference to one specific embodiment. It is expected that numerous alternatives and modified embodiments will become apparent to those skilled in the art, and it is intended that all such alternate and modified embodiments of the invention be included within the scope of the following claims.

I claim:

1. A compressor comprising a motor, a housing, a cylinder in said housing, a shaft driven by said motor, a reciprocating rod and piston assembly having a resilient annual seal for engaging said cylinder, means accessible from an upper surface of said rod and piston assembly for replacing said seal and for adjusting the length of said assembly, said means comprising a lower rod section having fastener engaging means, a main piston section having means for allowing passage of a fastener therethrough, a seal clamp for fixing said seal into engagement with said main piston section, and connecting means for fixing said main piston section, said seal clamp, and said seal to said lower rod section, said means for replacing and adjusting said assembly including shim means insertable between a lower end of said main piston section and an upper end of said lower rod section, said main piston section having at least one rib disposed on an upper surface thereof to positively engage said seal, said main piston section and said seal clamp have alignment means for facilitating their relative alignment.

2. A compressor in accordance with claim 1, wherein:

said alignment means comprise mating protrusion and recesses, non-alignment of which precludes connection of said main piston and said seal clamp.

* * * * *